US010070665B2

(12) United States Patent
Lavanchy et al.

(10) Patent No.: US 10,070,665 B2
(45) Date of Patent: Sep. 11, 2018

(54) EXTINGUISHER FOR A SMOKING ARTICLE

(71) Applicant: Philip Morris Products S.A., Neuchatel (CH)

(72) Inventors: Frederic Lavanchy, Grandson (CH); Laurent Manca, Sullens (CH); Sergey Krasiev, Le Mont-sur-Lausanne (CH); Samuel Malzach, Evilard (CH); Luc Amgwerd, Evilard (CH); Antonino Lanci, Bern (CH); Elmar Mock, Bienne (CH)

(73) Assignee: Philip Morris Products S.A., Neuchatel (CH)

( * ) Notice: Subject to any disclaimer, the term of this patent is extended or adjusted under 35 U.S.C. 154(b) by 393 days.

(21) Appl. No.: 14/651,796

(22) PCT Filed: Feb. 6, 2014

(86) PCT No.: PCT/EP2014/052298
§ 371 (c)(1),
(2) Date: Jun. 12, 2015

(87) PCT Pub. No.: WO2014/122200
PCT Pub. Date: Aug. 14, 2014

(65) Prior Publication Data

US 2015/0313279 A1 Nov. 5, 2015

(30) Foreign Application Priority Data

Feb. 6, 2013 (EP) ..... 13154161

(51) Int. Cl.
*A24F 13/18* (2006.01)

(52) U.S. Cl.
CPC ..... *A24F 13/18* (2013.01)

(58) Field of Classification Search
CPC ..... A24F 13/18
(Continued)

(56) References Cited

U.S. PATENT DOCUMENTS 1,788,646 A * 1/1931 Watkins ..... A24F 19/00 131/236
2,164,082 A * 6/1939 Pierce, Jr. ..... A24F 19/145 131/236

(Continued)

FOREIGN PATENT DOCUMENTS

CH 702 849 A2 9/2011
CN 2506096 Y 8/2002

(Continued)

OTHER PUBLICATIONS

Combined Chinese Office Action and Search Report dated Mar. 27, 2017 in Patent Application No. 201480007469.6 (with English Translation).

(Continued)

*Primary Examiner* — Cynthia Szewczyk
(74) *Attorney, Agent, or Firm* — Oblon, McClelland, Maier & Neustadt, L.L.P.

(57) ABSTRACT

There is provided a portable extinguisher for extinguishing a single smoking article at a time. The extinguisher includes an outer vessel, an inner sleeve, an opening, and a lid. The opening is sized to receive a single smoking article into the inner sleeve. The inner sleeve is within the outer vessel and is at least partially separated from the outer vessel. The inner sleeve includes at least one aperture allowing fluid communication between the inner sleeve and the outer vessel. The lid is for closing the extinguisher. When the lid is closed, escape of fluid from the extinguisher is prevented.

15 Claims, 4 Drawing Sheets

(58) Field of Classification Search
USPC ..... 131/235.1, 236, 237.5
See application file for complete search history.

(56) References Cited

U.S. PATENT DOCUMENTS

| | | | | |
|---|---|---|---|---|
| 3,078,854 | A | 2/1963 | Arthur | |
| 3,635,225 | A * | 1/1972 | Andrews | A24F 19/145 131/236 |
| 3,920,028 | A | 11/1975 | Kobayakawa | |
| 4,146,043 | A * | 3/1979 | Itoh | A24F 13/18 131/236 |
| 4,780,370 | A * | 10/1988 | Pointier | A24F 19/145 131/231 |
| 6,321,757 | B1 * | 11/2001 | McCutcheon | A24F 15/18 131/231 |
| 6,604,530 | B1 * | 8/2003 | Rogari | A24F 19/0064 131/231 |
| 8,276,749 | B1 | 10/2012 | Schrauwen et al. | |
| 2005/0236282 | A1 | 10/2005 | Huska | |
| 2009/0145448 | A1 | 6/2009 | Worlock et al. | |
| 2013/0312775 | A1 | 11/2013 | Cortesi | |

FOREIGN PATENT DOCUMENTS

| | | | |
|---|---|---|---|
| CN | 201136654 | Y | 10/2008 |
| CN | 201192069 | Y | 2/2009 |
| CN | 202085717 | U | 12/2011 |
| CN | 102318902 | A | 1/2012 |
| CN | 202151106 | U | 2/2012 |
| EP | 0 350 739 | A1 | 1/1990 |
| FR | 2 936 398 | A1 | 4/2010 |
| JP | 47-133543 | | 8/1974 |
| JP | 54-140673 | | 11/1979 |
| JP | 59-203484 | | 11/1984 |
| JP | 9-252758 | A | 9/1997 |
| JP | 10-127265 | A | 5/1998 |
| JP | 10-215845 | | 8/1998 |
| JP | 11-113553 | A | 4/1999 |
| JP | 11-225735 | | 8/1999 |
| JP | 2000-342241 | A | 12/2000 |
| JP | 2002-360236 | | 12/2002 |
| JP | 2007-312724 | A | 12/2007 |
| WO | 2004 019710 | | 3/2004 |
| WO | WO 2006/063398 | A1 | 6/2006 |
| WO | WO 2009/022232 | A2 | 2/2009 |
| WO | 2012 110948 | | 8/2012 |

OTHER PUBLICATIONS

International Search Report and Written Opinion of the International Searching Authority dated May 14, 2014 in PCT/EP2014/052298 Filed Feb. 6, 2014.

Russian Office Action dated Sep. 12, 2017 in Patent Application No. 2015137783 (with English Translation).

Japanese Office Action with English translation dated Oct. 27, 2017 in corresponding Japanese Patent Application No. 2015-556487, citing documents AO-AT therein (17 pages).

Chinse Office Action with English translation dated June 5, 2018 in the corresponding Chinese Patent Application No. 201480067489.6, citing document AO therein (18 pages).

* cited by examiner

EXTINGUISHER FOR A SMOKING ARTICLE

CROSS REFERENCE TO RELATED APPLICATION

This application is a U.S. national phase application under 35 U.S.C. § 371 of PCT/EP2014/052298, filed on Feb. 6, 2014, and claims the benefit of priority under 35 U.S.C. § 119 from prior EP Application No. 13154161.7, filed on Feb. 6, 2013, the entire contents of each of which are incorporated herein by reference.

The present invention relates to an extinguisher for a smoking article. In particular, the present invention relates to a portable extinguisher for extinguishing a single smoking article at a time.

A number of smoking articles in which tobacco is heated rather than combusted have been proposed in the art. An aim of such heated smoking articles is to reduce known harmful smoke constituents produced by the combustion and pyrolytic degradation of tobacco in conventional cigarettes. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. The aerosol forming material may be located within, around or downstream of the fuel element. For example, WO-A-2009/022232 discloses a smoking article comprising a combustible heat source, an aerosol-generating substrate downstream of the combustible heat source and a heat-conducting element around and in contact with a rear portion of the combustible heat source and an adjacent front portion of the aerosol-generating substrate. During smoking, volatile compounds are released from the aerosol forming material by heat transfer from the fuel element and entrained in air drawn through the smoking article. As the released compounds cool they condense to form an aerosol that is inhaled by the consumer.

Smoking articles, which include a combustible fuel element or heat source, may have a combustion zone or zone of heating that is larger, more dense, and not as readily extinguished by crushing or "stubbing out" the heat source compared to a conventional cigarette, in which tobacco is burnt or combusted to heat and release volatile compounds from the tobacco. Such smoking articles may have a heat source that contains significantly more energy in the form of heat than found in the combustion zone of a conventional cigarette. Consequently, such smoking articles may require more effort to extinguish or to remove sufficient heat to facilitate disposal.

Accordingly, it would be desirable to provide an improved extinguisher for smoking articles, particularly one which may be used with smoking articles that include a combustible fuel element or heat source.

According to a first aspect of the invention, there is provided a portable extinguisher for extinguishing a single smoking article at a time, the extinguisher comprising: an outer vessel; an inner sleeve; an opening sized to receive a single smoking article into the inner sleeve; and a lid for closing the extinguisher; wherein the inner sleeve is within the outer vessel and is at least partially separated from the outer vessel, the inner sleeve comprises at least one aperture allowing fluid communication between the inner sleeve and the outer vessel, and the lid, when closed, prevents escape of fluid from the extinguisher.

The extinguisher according to the invention is a portable extinguisher, which has a conveniently small size for a user and is particularly suited to extinguishing smoking articles that include a combustible fuel element or heat source.

The extinguisher may be used with any type of smoking article. Throughout this specification, the term "smoking articles" should be inferred to mean, not only conventional cigarettes, in which the substrate, usually tobacco, is combusted, but also smoking articles, for example heated smoking articles, in which the substrate is heated rather than combusted and which rely on aerosol formation from the heated substrate, and distillation-based smoking articles, including those having a combustible heat source, such as the smoking article described in WO-A-2009/022232. The extinguisher is particularly useful for extinguishing heated smoking articles in which an aerosol is generated by the transfer of heat from a combustible fuel element or heat source to a physically separate aerosol forming material, which may be located within, around or downstream of the fuel element.

The inner sleeve and outer vessel are at least partially separated from one another. For example, the inner sleeve and outer vessel may be at least partially separated by a space. The separation provides insulation, which may reduce heat transfer to the exterior of the extinguisher. This may prevent heat from the smoking article burning a user's hands. This may be particularly important when the extinguisher is used with smoking articles including a combustible fuel element or heat source, because such smoking articles may have a heat source containing a significant amount of heat energy that should be dissipated to facilitate easy disposal.

The term "fluid" used throughout this specification refers to any substance which can flow freely and which can assume the shape of its container. Suitable fluids include, but are not limited to, liquids, gases, creams, foams, gels, powders (such as sand), particulate materials and granular materials, and combinations thereof. The extinguisher may be used with or without fluid but, if fluid is used, the lid prevents leakage of the fluid from the extinguisher. Preferably, the extinguisher is used with fluid. This facilitates extinguishing of the smoking article. To facilitate extinguishing, preferably the fluid has a high heat capacity and provides instant suffocation of the heat source so as to extinguish it. Preferably, the fluid is water. In an alternative embodiment, however, the fluid is a powder, for example sand. However, any suitable fluid or combination of fluids may be used. The extinguisher may be pre-filled with fluid. Alternatively, the extinguisher may be fillable by a user. The extinguisher may be filled with fluid via an opening in the outer vessel or in the inner sleeve. The extinguisher may be filled with fluid via the opening which is sized to receive a single smoking article.

The at least one aperture in the inner sleeve allows fluid communication between the inner sleeve and the outer vessel, so that fluid in the inner sleeve can flow freely between the inner sleeve and the outer vessel. This allows a larger volume of fluid to be contained within the extinguisher than if the fluid were contained only in the inner sleeve. This may be particularly advantageous when the extinguisher is used with smoking articles including a combustible fuel element or heat source, because such smoking articles may have a combustion zone or zone of heating that is larger, more dense, and not as readily extinguished by crushing or "stubbing out" the heat source compared to a conventional cigarette. The larger volume of fluid has a larger heat capacity and therefore acts as a greater heat sink for extinguishing the smoking article.

The extinguisher is sized so as to be hand-held or portable, and suitable for extinguishing a single smoking article at a time. The opening has a size such that only a single smoking article at a time can be received into the inner sleeve. Preferably, the opening is substantially circular, so as to receive a smoking article having a substantially circular cross section. Preferably, the extinguisher is sized to extinguish a single smoking article but not to store smoking articles, either extinguished or unused. In heated smoking articles, including those which include a combustible fuel element or heat source, the aerosol generating substrate is not burned in the same way as in a conventional cigarette. Thus, the used smoking article may be substantially the same size as the unused smoking article. This is not the case for conventional cigarettes, where the unused cigarette is generally considerably larger than the used cigarette. Storage for used, extinguished heated smoking articles might therefore need to be considerably larger than storage for extinguished conventional cigarettes. By providing an extinguisher which is sized to extinguish only a single smoking article at a time, and not to store smoking articles, the portable extinguisher can be made smaller and more convenient for a user. Additionally, the portable extinguisher may be advantageously sized so that it unobtrusively clips to the bottom of smoking article packaging.

If the extinguisher is arranged to extinguish conventional smoking articles, the extinguisher is sized to be suitable for extinguishing a single conventional smoking article at a time. Preferably, however, the extinguisher is arranged to extinguish smoking articles including a combustible fuel element or heat source. In that case, the extinguisher is sized to be suitable for extinguishing a single smoking article, including a combustible fuel element or heat source, at a time.

Preferably, the extinguisher is arranged to extinguish smoking articles having a diameter between about 5 mm and about 9 mm. More preferably, the extinguisher is arranged to extinguish smoking articles having a diameter between about 7 mm and about 8 mm. Preferably, the opening has a cross section between about 8 mm and about 9 mm. More preferably, the opening has a cross section of about 9 mm.

The external shape of the extinguisher is preferably elongate in height with a cross section that is substantially rectangular. Other alternative suitable shapes may be used, including, for example, circular, oval, trigonal, octagonal, rhomboidal, trapezoidal, or any combination thereof. In certain preferred embodiments, the extinguisher has a height of between about 50 mm and about 60 mm and a depth between about 13 mm and about 23 mm. The external dimensions of the extinguisher may be adjusted.

The useable volume of the extinguisher is preferably between about 5 ml and about 9 ml. With water as the extinguishing fluid, the extinguisher may be arranged to extinguish between about 20 and 30 smoking articles before more fluid is required.

The outer vessel may comprise any suitable material or materials. Suitable materials include, but are not limited to, metal, glass, polypropylene (PP), polyethylene (PE), polyamide (PA), polystyrene (PS) and silicone, or combinations thereof. In a preferred embodiment, the outer vessel comprises polypropylene. In certain preferred embodiments, the outer vessel includes an inner coating. If present, the inner coating is preferably silicone.

Preferably, the outer vessel is laser welded. Laser welding allows a precision shape to be achieved. This may assist in reducing the likelihood of leakage of fluid from the extinguisher when the lid is closed.

The outer vessel is at least partially separated from the inner sleeve. The separation may be any suitable separation which limits heat transfer between the inner sleeve and the outer vessel. For example, the outer vessel may be at least partially separated from the inner sleeve by a space. When the extinguisher is used with fluid, the fluid may partially or completely fill the space. Alternatively, the space may be separate from the fluid-containing portion of the outer vessel or inner sleeve. For example, the outer vessel may be at least partially separated from the inner sleeve by structural members, for example ribs, buttresses, props, supports, struts or a honeycomb structure. Preferably, the inner sleeve and outer sleeve are in contact at one or more locations within the outer vessel. This provides structural support and integrity for the extinguisher. For example, the inner sleeve may be in contact with the outer vessel at two opposite ends, so as to retain the inner sleeve in a proper position within the outer vessel.

In one embodiment, the outer vessel is at least partially transparent. Throughout this specification, the term "transparent" is used to mean that sufficient light may pass through, such that the level of fluid inside the outer vessel may be seen from the outside by a user. This is advantageous because it reduces the chance of fluid overflow from the extinguisher, since a user can see how much fluid the extinguisher contains and is less likely to overfill the extinguisher.

The outer vessel may be partially transparent. For example, one or more surfaces of the outer vessel may be transparent. For example, one or more transparent windows may be provided. Alternatively, the outer vessel may be entirely transparent. The transparency will depend on the material or combination of materials of the outer vessel.

The extinguisher may further comprise a fluid level indicator. This is advantageous because it reduces the likelihood that a user will overfill the extinguisher. The fluid level indicator preferably indicates a minimum fluid level. The minimum fluid level may indicate a minimum amount of fluid required to properly extinguish a smoking article. The fluid level indicator preferably indicates a maximum fluid level. The maximum fluid level may indicate a maximum amount of fluid, above which the fluid in the extinguisher may overflow when a smoking article is received in the inner sleeve.

The fluid level indicator may be visible from the exterior of the outer vessel. Alternatively, the fluid level indicator may only be visible when the lid is open. The fluid level indicator may be provided on the outer vessel or on the inner sleeve. If the outer vessel is at least partially transparent, the fluid level indicator may be provided on an exterior surface of the outer vessel or on the inner sleeve. If the outer vessel is at least partially transparent, the fluid level indicator may comprise minimum and maximum fluid level indicators on an exterior surface of the outer vessel or on the inner sleeve.

The fluid level indicator may be on sticker applied to an exterior surface of the outer vessel. For example, if the outer vessel is at least partially transparent, the sticker, when applied to the outer vessel, may reveal a transparent window in the outer vessel. The sticker may include minimum and maximum fluid level indicators adjacent the window.

The exterior surfaces of the outer vessel may be printed, embossed, debossed or otherwise embellished with manufacturer or brand logos, trade marks, slogans and other consumer information and indicia. If a sticker is applied to an exterior surface of the outer vessel, the sticker may be printed, embossed, debossed or otherwise embellished with manufacturer or brand logos, trade marks, slogans and other consumer information and indicia.

The outer vessel may include at least one guide for positioning the inner sleeve within the outer vessel. The at least one guide positions the inner sleeve correctly relative to the outer vessel such that the inner sleeve is at least partially separated from the outer vessel. This separation provides insulation, which may prevent heat from the smoking article burning a user's hands. The at least one guide may also ensure that the inner sleeve cannot move relative to the outer vessel, for example when a smoking article is received in the inner sleeve. This may provide stability.

The inner sleeve may comprise any suitable material or materials. Suitable materials include, but are not limited to, oxidative-resistant metals or alloys, such as stainless steel (also known as Inox), for example stainless steel grade 1.4301, thermoset materials, such as thermoset melamine formaldehyde (thermoset MF), and high-temperature heat resistant materials, such as clay, silicate, or silicone, or combinations thereof. In a preferred embodiment, the inner sleeve comprises stainless steel.

The inner sleeve may be removable from the outer vessel by a user. This may be advantageous for cleaning, for example. The inner sleeve may be disposable.

The inner sleeve may have any suitable shape and size. The inner sleeve may have a shape and a size designed for maximum heat dissipation. The inner sleeve may be elongate. The inner sleeve may have a circular cross section. The at least one aperture should have a size and position on the inner sleeve to allow fluid communication between the inner sleeve and the outer vessel, during normal use of the extinguisher. The inner sleeve may comprise a cage or mesh structure. The inner sleeve may be open or closed at the end opposite the opening.

The inner sleeve preferably has a size suitable for only one smoking article. This reduces the overall size of the extinguisher. For example, the inner sleeve may comprise an elongate sleeve with a substantially circular cross section, the diameter of which is slightly larger than the diameter of a smoking article. The inner sleeve may extend completely across the interior of the outer vessel or may extend only partially across the interior of the outer vessel.

Preferably, the extinguisher further comprises a stopper for limiting the extent a smoking article can extend into the extinguisher. The stopper may form part of the outer vessel. Additionally or alternatively, the stopper may form part of the inner sleeve. Providing a stopper may reduce the chance of fluid overflow when a smoking article is received in the inner sleeve.

The opening is sized to receive a single smoking article into the inner sleeve. Thus, irrespective of the size of the inner sleeve, the size of the opening ensures that only a single smoking article can be extinguished at a time. The opening should be positioned such that a smoking article inserted into the opening is received in the inner sleeve. Depending on the design of the extinguisher, the opening may be an opening in the inner sleeve or an opening in the outer vessel or an opening in both the inner sleeve and the outer vessel.

Preferably, the extinguisher comprises a lip defining the opening. The lip partially or completely bounds the opening.

The lip may be curved. That is, the lip may have a curved profile, providing a smooth transition between the outer side and the inner side of the opening. For example, the lip may comprise a first portion on the outer side of the opening, a second portion on the inner side of the opening and a curved portion joining the first and second portions. Alternatively or additionally, the lip may be rounded. That is, the opening defined by the lip may have a rounded (for example, a circular) shape. The lip, which may be curved, rounded or both curved and rounded, may provide a smooth opening for receiving a smoking article. This may reduce the chance of breaking or damaging the smoking article or part of the smoking article. This is particularly advantageous if the smoking article comprises a combustible fuel element or heat source, because the fuel element or heat source may be fragile and prone to breakage. The lip, which may be curved, rounded or both curved and rounded, may also facilitate insertion of the smoking article into the opening and inner sleeve. This is advantageous because the opening likely has a cross section similar to the diameter of a smoking article. Thus, there may be a tight fit between the smoking article and the opening.

Depending on the design of the extinguisher, the lip, which may be curved, rounded or both curved and rounded, may form part of the inner sleeve. Depending on the design of the extinguisher, the lip, which may be curved, rounded or both curved and rounded, may form part of the outer vessel. The lip may be a separate component arranged to be attached to the inner sleeve or outer vessel or both inner sleeve and outer vessel. The lip may comprise any suitable material. Preferably, the lip comprises stainless steel.

If the extinguisher comprises a lip defining the opening, preferably, the lip is heat-resistant. The heat-resistant lip may reduce the chance of heat damage to the extinguisher as the smoking article is received in the opening. This may be particularly advantageous if the smoking article comprises a combustible fuel element or heat source.

Depending on the design of the extinguisher, the heat-resistant lip may form part of the inner sleeve. Depending on the design of the extinguisher, the heat-resistant lip may form part of the outer vessel. The heat-resistant lip may be a separate component arranged to be attached to the inner sleeve or outer vessel or both inner sleeve and outer vessel. The heat-resistant lip may comprise any suitable heat-resistant material. Preferably, the heat-resistant lip comprises stainless steel.

The lid may comprise any suitable material or materials. Suitable materials include, but are not limited to, polypropylene (PP), polyethylene (PE), polyamide (PA), polystyrene (PS) and silicone, or combinations thereof. In a preferred embodiment, the lid comprises polypropylene. Preferably, the lid is laser welded. Laser welding allows a precision shape to be achieved. This may assist in reducing the likelihood of leakage of fluid from the extinguisher when the lid is closed.

In one embodiment, the outer vessel comprises a combination of polypropylene, polyethylene and silicone, the lid comprises polypropylene and the inner sleeve comprises stainless steel. In another embodiment, the outer vessel comprises a combination of polyamide and polystyrene, the lid comprises polypropylene and the inner sleeve comprises silicone. In another embodiment, the outer vessel comprises a combination of polypropylene, polyamide and polystyrene, the lid comprises polypropylene and the inner sleeve comprises thermoset melamine formaldehyde. However, in a preferred embodiment, the outer vessel comprises polypropylene, the lid comprises polypropylene and the inner sleeve comprises stainless steel.

The lid, when closed, prevents escape of fluid from the extinguisher. Preferably, the lid, when closed, creates a watertight seal. The lid is preferably arranged to close the opening which is sized to receive a single smoking article into the inner sleeve. The lid may be arranged to close any further openings which are provided in the extinguisher, or additional lids for those openings may be provided.

Preferably, the lid comprises a member arranged to cooperate with the opening when the lid is closed, to prevent escape of fluid from the extinguisher. For example, the lid may comprise a plug which is received in the opening when the lid is closed. If the opening comprises a lip, which may be any of curved, rounded and heat-resistant, preferably the lid comprises a member arranged to cooperate with the lip when the lid is closed. For example, the lid may comprise a plug which engages with the lip when the lid is closed. The lid or opening or both the lid and the opening may include an O-ring, to assist in creating a seal. The O-ring or O-rings may comprise any suitable material or materials, for example, but not limited to nitrile butadiene rubber (NBR).

The lid may have any form suitable for use with the extinguisher. The lid may be separate from the outer vessel or attached to the outer vessel. For example, the lid may be a snap-fit lid, a sliding lid, a hinge lid or a flip top lid. If the lid is attached to the outer vessel, the lid may be formed integrally with the outer vessel or may be fastened to the outer vessel, for example using a hinge pin.

The exterior surfaces of the lid may be printed, embossed, debossed or otherwise embellished with manufacturer or brand logos, trade marks, slogans and other consumer information and indicia.

The portable extinguisher may comprise means for attaching the extinguisher to another object. Preferably, the portable extinguisher further comprises a clip for attaching the extinguisher to another object. For example, the clip may be arranged to attach the extinguisher to a pack of smoking articles. Preferably, the smoking articles are smoking articles which can be extinguished by the extinguisher. The dimensions of the extinguisher may be selected to match dimensions of the pack. For example, in one embodiment, the height of the extinguisher may substantially match the width of the pack and the depth of the extinguisher may substantially match the depth of the pack. Thus, the extinguisher may unobtrusively clip to the bottom of the pack.

The clip may comprise any suitable material or materials, including, but not limited to stainless steel, for example stainless steel grade 1.4301, and stainless spring steel, or combinations thereof.

The clip may be integrally formed with a part of the extinguisher, for example the outer vessel or lid. Alternatively, the clip may be a separate component which is fixed to a part of the extinguisher, for example the outer vessel or lid. The clip may be fixed by any suitable means, for example, but not limited to, a snap-fit, a spring-fit, glue or fixing means, for example one or more screws.

According to a second aspect of the invention, there is provided a portable extinguisher for extinguishing a single smoking article at a time, the extinguisher comprising: an outer vessel; an inner sleeve, the inner sleeve being within the outer vessel, being at least partially separated from the outer vessel, and comprising at least one aperture allowing fluid communication between the inner sleeve and the outer vessel; an opening sized to receive a single smoking article into the inner sleeve; fluid contained within the inner sleeve and outer vessel; and a lid for closing the extinguisher, the lid, when closed, preventing escape of the fluid from the extinguisher.

In one embodiment, the fluid comprises water. In one embodiment, the fluid comprises powder.

Features described in relation to one aspect of the invention may also be applicable to the other aspect of the invention.

The invention will be further described, by way of example only, with reference to the accompanying drawings in which.

The invention provides a portable extinguisher for extinguishing a single smoking article. As discussed above, one particularly useful application of the portable extinguisher is for extinguishing heated smoking articles in which an aerosol is generated by the transfer of heat from a combustible fuel element or heat source to a physically separate aerosol forming material, which may be located within, around or downstream of the fuel element.

Figure 1:
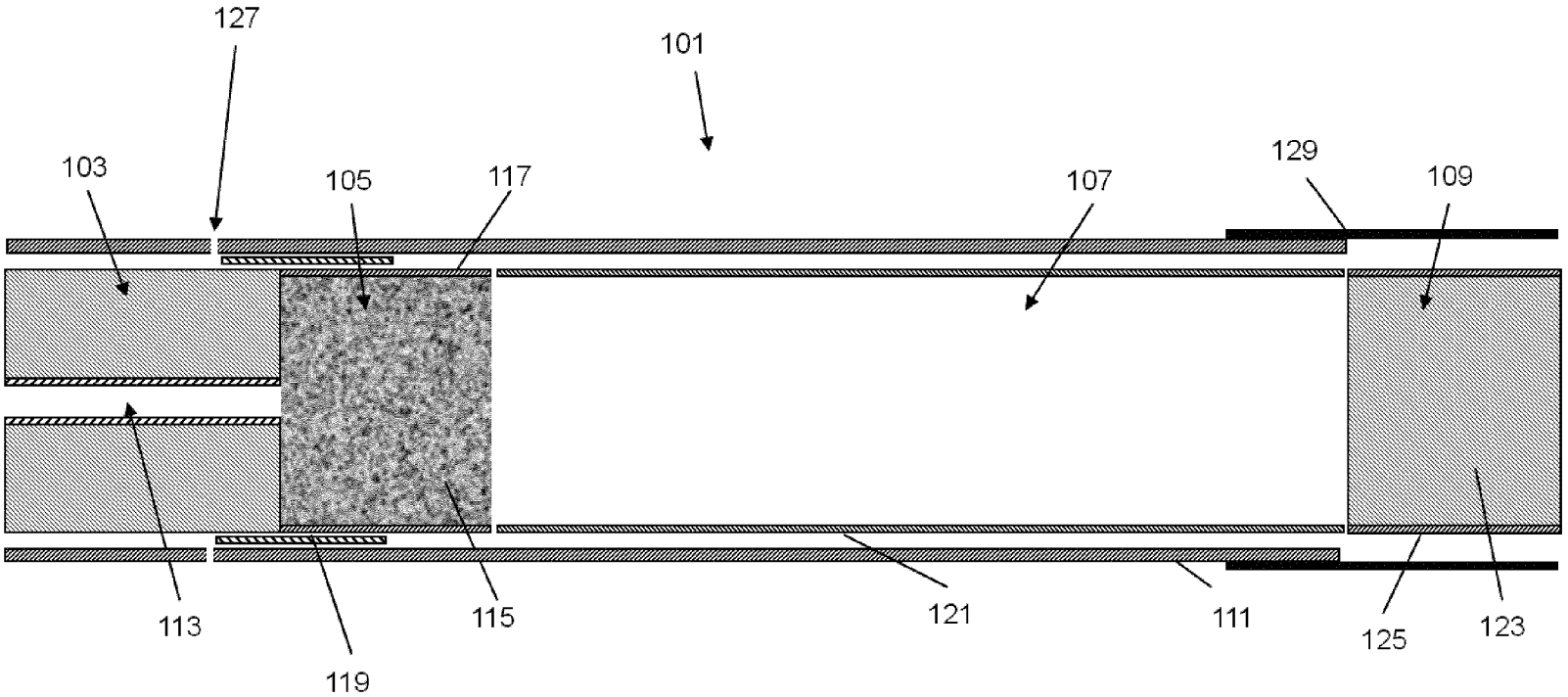
FIG. 1 shows a smoking article including a combustible heat source.

FIG. 1 shows one example of a smoking article with which the extinguisher of the invention may be used. FIG. 1 shows a smoking article similar to that described in WO-A-2009/022232. The smoking article 101 comprises a combustible heat source 103, an aerosol-generating substrate 105, an elongate expansion chamber 107 and a mouthpiece 109 in abutting coaxial alignment, which are overwrapped in an outer wrapper of cigarette paper 111. The combustible heat source 103 is cylindrical and comprises a central airflow channel 113 which extends longitudinally through the heat source 103. The aerosol-generating substrate 105 is located immediately downstream of the combustible heat source 103 and comprises a cylindrical plug of homogenised tobacco material 115 comprising glycerine as aerosol former and circumscribed by filter plug wrap 117. A heat-conducting element 119, consisting of a tube of aluminium foil, surrounds and is in contact with a rear portion of the combustible heat source 103 and an abutting front portion of the aerosol-generating substrate 105. The elongate expansion chamber 107 is located downstream of the aerosol-generating substrate 105 and comprises a cylindrical open-ended tube of cardboard 121. The mouthpiece 109 is located downstream of the expansion chamber 107 and comprises a cylindrical plug of cellulose acetate tow 123 circumscribed by filter plug wrap 125. In this embodiment, the outer wrapper of cigarette paper 111 includes perforations 127 around its circumference, just upstream of the heat conducting element 119. The smoking article 101 is circumscribed by tipping paper 129.

The extinguisher of the present invention may be used to extinguish any smoking article, but finds particular application as an extinguisher for smoking articles like the one shown in FIG. 1.

Figure 2:
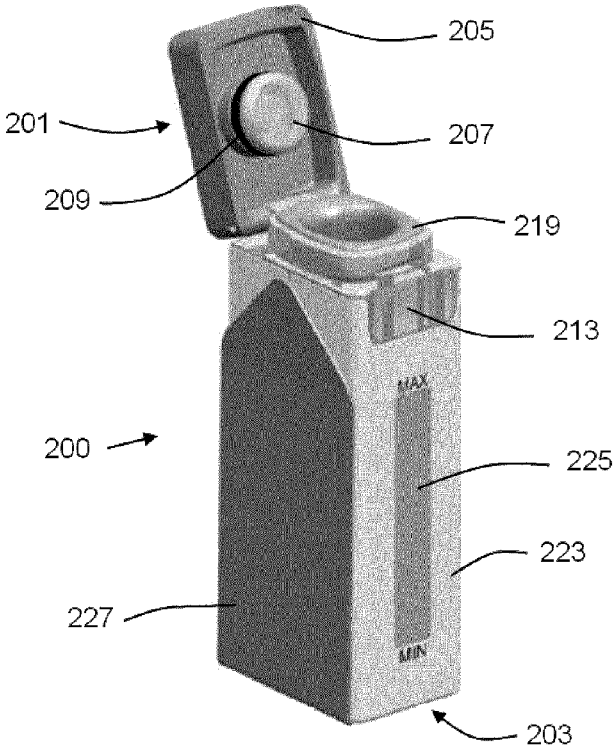
FIG. 2 is a perspective view of an extinguisher according to a first embodiment of the invention, with the lid open.
Figure 3:
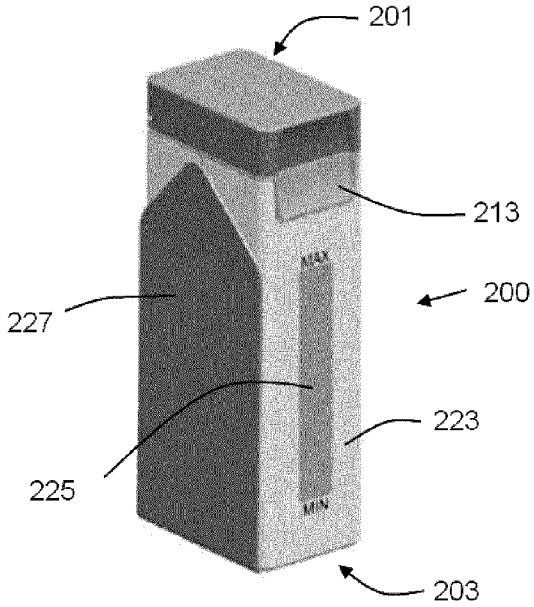
FIG. 3 is a perspective view of the extinguisher of FIG. 2, with the lid closed.
Figure 4:
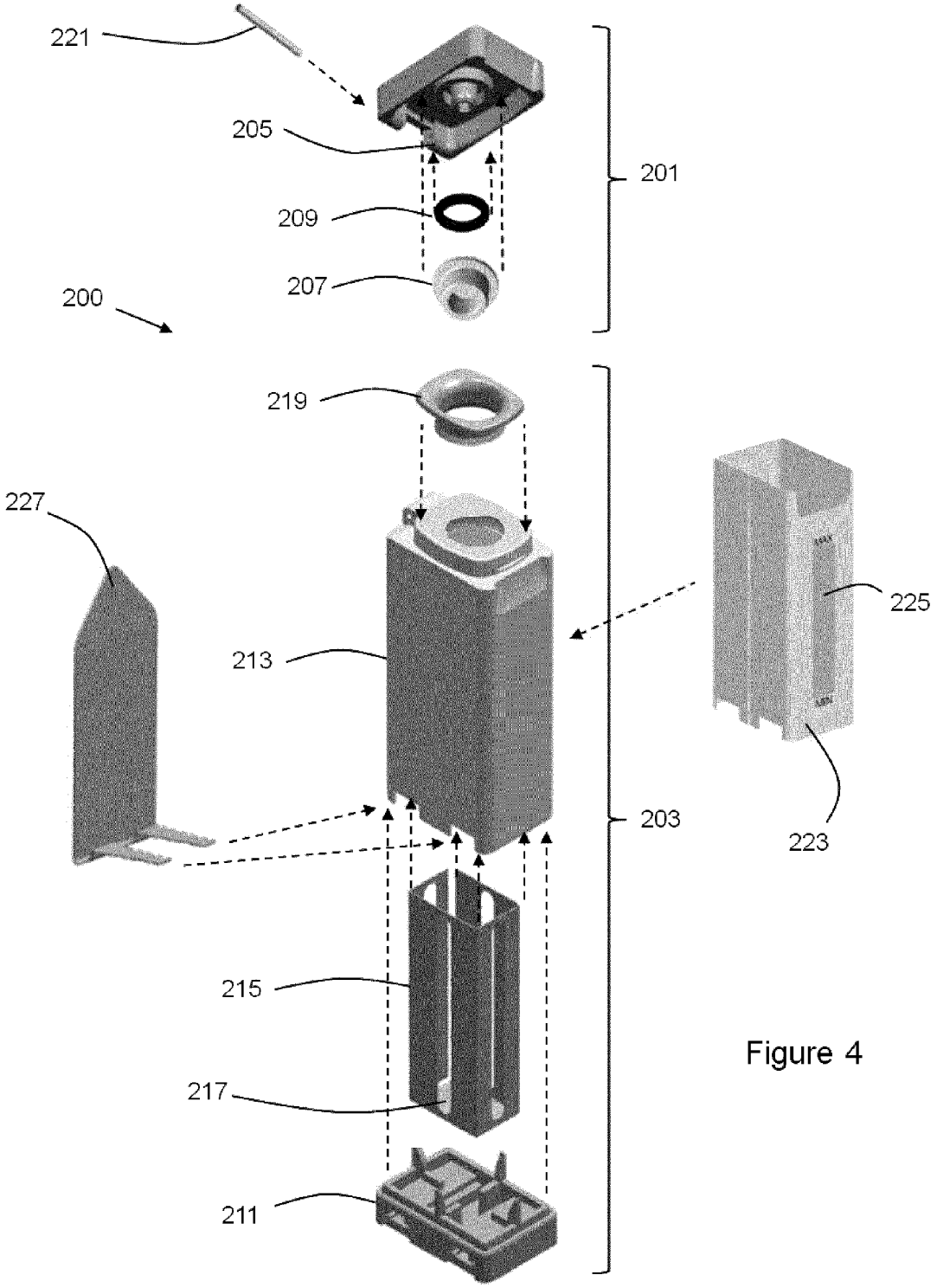
FIG. 4 is an expanded view of the extinguisher of FIGS. 3 and 4.

FIGS. 2 and 3 are perspective views of an extinguisher according to a first embodiment of the invention. FIG. 2 shows the lid of the extinguisher open and FIG. 3 shows the lid of the extinguisher closed. FIG. 4 is an expanded view of the extinguisher shown in FIGS. 2 and 3.

Referring to FIGS. 2, 3 and 4, extinguisher 200 comprises a lid 201 and a base 203. Lid 201 comprises cap 205, plug 207 and O-ring 209. Base 203 comprises outer vessel in the form of support 211 and vessel 213, inner sleeve 215 having apertures 217, and lip 219. The plug 207 may be attached to the cap 205 and the O-ring 209 provides a watertight seal when the plug 207 is attached to the cap 205. Inner sleeve 215 fits within vessel 213. Both vessel 213 and inner sleeve 215 are attached to support 211. This provides stability, particularly for inner sleeve 215. The interior of the vessel 213 may include guides (not shown) for positioning the inner sleeve 215 within the vessel 213. Apertures 217 in the inner sleeve 215 allow fluid in the extinguisher to flow between the inner sleeve and the outer vessel.

The lip 219 forms an opening for the inner sleeve 215 which is sized to receive a single smoking article. In this embodiment, the lip is a separate component which may be attached to vessel 213. Alternatively, the lip may be attached to the inner sleeve. The lip may be attached to the vessel or inner sleeve with an O-ring (not shown) to create a watertight seal. Alternatively, the lip may be integral with the outer vessel or inner sleeve.

In this embodiment, lid 201 is a hinge lid which may be attached to base 203 with pin 221. Lid 201 is moveable between an open position (shown in FIG. 2) and a closed position (shown in FIG. 3). When the lid 201 is in the closed position, plug 207 in lid 201 engages with lip 219 in base 203 to provide a watertight seal.

Extinguisher 200 further comprises a sticker 223 which may be applied to vessel 213. In this embodiment, vessel 213 is transparent so that the level of fluid within the extinguisher may be seen from the exterior of the extinguisher. The sticker 223 is opaque but includes a window 225. Thus, when sticker 223 is applied to vessel 213, a user can see the fluid level in the extinguisher through the window 225. The sticker 223 includes minimum and maximum fluid level indicators adjacent window 225. Extinguisher 200 further comprises a clip 227 which may be attached to support 211. The clip may then be used to attach the extinguisher to another object and this will be described further with reference to FIG. 6.

In the embodiment illustrated in FIGS. 2, 3 and 4, the cap 205 comprises polypropylene, the plug 207 comprises polypropylene, the O-ring 209 comprises nitrile butadiene rubber, the support 211 comprises polypropylene, the vessel 213 comprises polypropylene, the inner sleeve 215 comprises stainless steel, the lip 219 comprises stainless steel, the pin 221 comprises stainless steel, the sticker 223 comprises plastic and the clip 227 comprises stainless spring steel.

Figure 5:
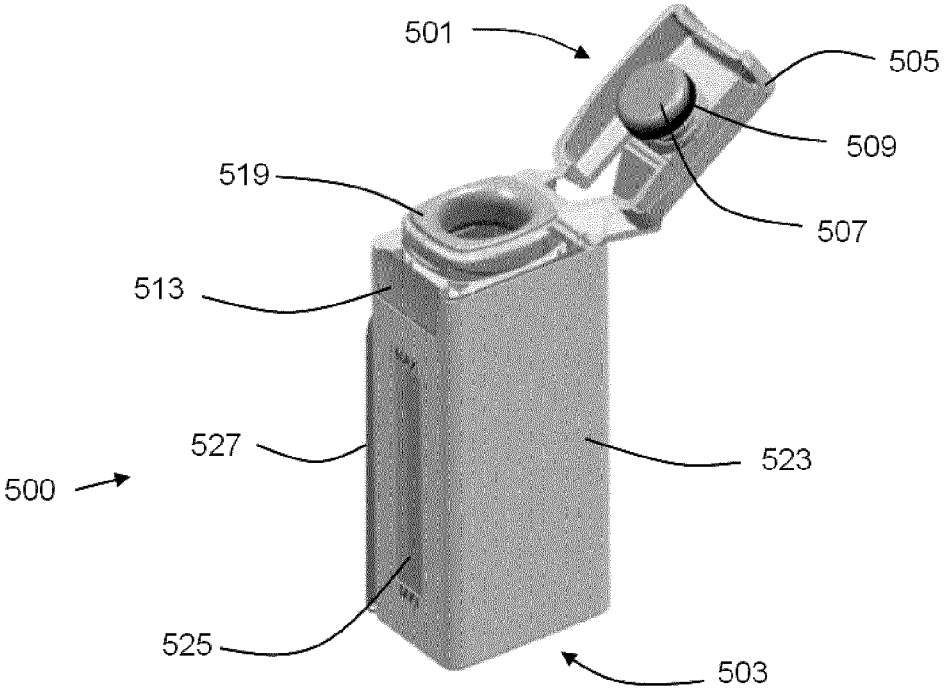
FIG. 5 is a perspective view an extinguisher according to a second embodiment of the invention, with the lid open.

FIG. 5 is a perspective view of an extinguisher 500 according to a second embodiment of the invention. FIG. 5 shows the lid of the extinguisher in an open position. Extinguisher 500 shown in FIG. 5 is very similar to extinguisher 200 shown in FIGS. 2, 3 and 4 except that lid and base are constructed from a single piece of material. The lid may be referred to as a flip top lid.

More specifically, extinguisher 500 comprises a lid 501 and a base 503. Lid 501 comprises cap 505, plug 507 and O-ring 509. The plug 507 is attached to the cap 505 and the O-ring 509 provides a watertight seal. Base 503 comprises outer vessel in the form of support (not shown) and vessel 513, inner sleeve (not shown) within vessel 513, and lip 519. Apertures (not shown) are provided in the inner sleeve to allow fluid to flow between the inner sleeve and the outer vessel. The lip 519 forms an opening for the inner sleeve which is sized to receive a single smoking article. As in the embodiment of FIGS. 2, 3 and 4, the lip may alternatively be integral with the outer vessel or inner sleeve. When the lid 501 is in the closed position, plug 507 in lid 501 engages with lip 519 in base 503 to provide a watertight seal.

Extinguisher 500 further comprises a sticker 523 applied to vessel 513. As in the embodiment of FIGS. 2, 3 and 4, the vessel is transparent and the sticker 523 is opaque but includes a window 525. Thus, when sticker 523 is applied to vessel 513, a user can see the fluid level in the extinguisher through the window 525. The sticker 523 includes minimum and maximum fluid level indicators adjacent window 225. Extinguisher 500 further comprises a clip 527 (just seen in FIG. 5) which may be used to attach the extinguisher to another object.

In the embodiment illustrated in FIG. 5, the cap 505 and vessel 513 comprise polypropylene, the plug 507 comprises polypropylene, the O-ring 509 comprises nitrile butadiene rubber, the support comprises polypropylene, the inner sleeve comprises stainless steel, the lip 519 comprises stainless steel, the sticker 523 comprises plastic and the clip 527 comprises stainless spring steel.

In the embodiment illustrated in FIGS. 2, 3 and 4, and the embodiment illustrated in FIG. 5, the extinguisher has a total height of about 55 mm, a depth of about 22.5 mm without the sticker and about 22.7 mm with the sticker, and a width of about 15.4 mm without the sticker and about 15.6 mm with the sticker. In the embodiment illustrated in FIGS. 2, 3 and 4, and the embodiment illustrated in FIG. 5, the extinguisher is arranged to extinguish smoking articles having a length of about 70 mm and a diameter of about 7.9 mm.

The inventors of the present invention have tested the extinguishers shown in FIGS. 2 to 5, with the following results.

In a first test, the extinguisher contained approximately 7 ml (7 g) of water at the start of the test. Five smoking articles were successively extinguished and each extinguish operation was performed 4 minutes after lighting the smoking article. Each smoking article was held in the water for 5 seconds and there was a 5 minute interval between extinguishing each smoking article. The inventors found a water loss of approximately 0.4 g and a water temperature increase of approximately 4° C. for each smoking article extinguished.

In a second test, the extinguisher contained approximately 2 ml (2 g) of water at the start of the test. Three smoking articles were successively extinguished and each extinguish operation was performed 4 minutes after lighting the smoking article. Each smoking article was held in the water for 5 seconds and there was a 5 minute interval between extinguishing each smoking article. The inventors found a water loss of approximately 0.15 g and a water temperature increase of between approximately 8° C. and approximately 11° C. for each smoking article extinguished.

Figure 6:
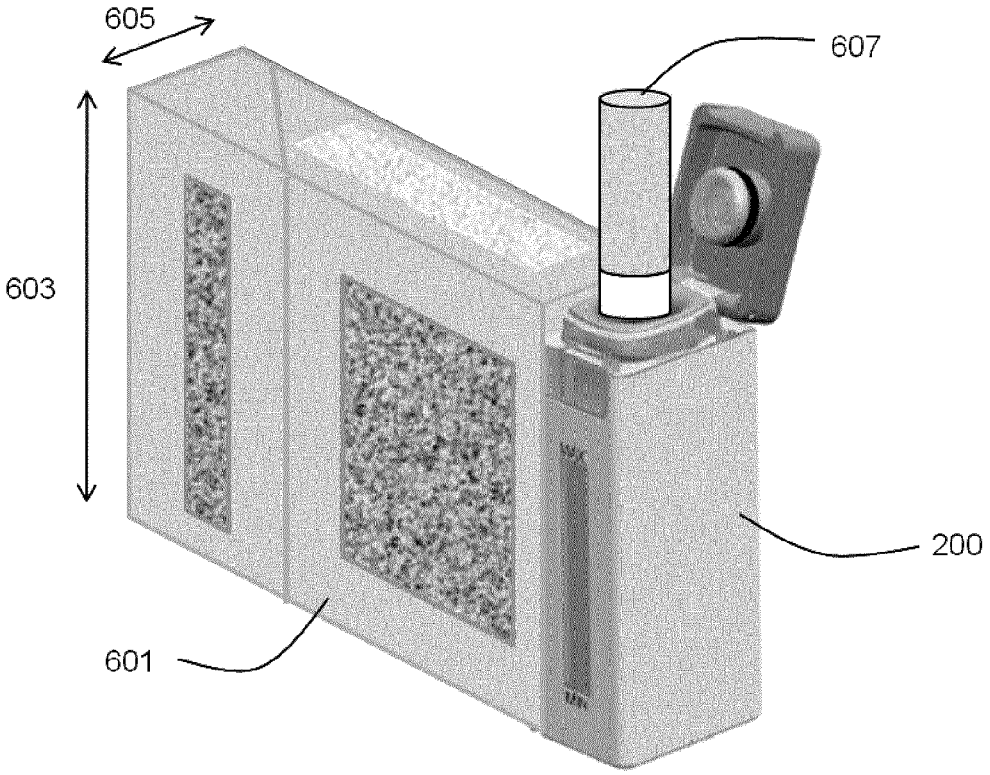
FIG. 6 is a schematic view of the extinguisher of FIGS. 2, 3 and 4 attached to a pack of smoking articles.

FIG. 6 is a schematic view of the extinguisher 200 of FIGS. 2, 3 and 4 attached to a pack 601 of smoking articles. In FIG. 6, extinguisher 200 is attached to the bottom of the pack 601 of smoking articles although the extinguisher 200 could be attached to another surface, as desired. The clip 227 (not shown in FIG. 6) is inside the pack 601, such that the bottom surface of the pack 601 is between the clip 227 and the vessel 213. In this embodiment, the pack 601 is a standard hinge lid container for smoking articles. However, the extinguisher may be attached to a pack of any shape, size and configuration. In FIG. 6, the width 603 of the pack 601 is substantially equal to the height of the extinguisher 200 and the depth 605 of the pack 601 is substantially equal to the depth of the extinguisher 200. Therefore, when the extinguisher 200 is clipped to the pack 601, the combination of extinguisher 200 and pack 601 has a substantially cuboid shape. Therefore, the extinguisher 200 is clipped to the pack 601 in a relatively unobtrusive manner.

In FIG. 6, a smoking article 607 is received in the opening formed by the lip 219 and extends into the inner sleeve (not shown) inside the vessel 213. The smoking article 607 is being extinguished by the extinguisher 200.

The invention claimed is:

1. A portable extinguisher for extinguishing a single smoking article at a time, the extinguisher comprising:

an outer vessel;

an inner sleeve;

an opening sized to receive a single smoking article into the inner sleeve; and a lid configured to close the extinguisher, wherein the inner sleeve is disposed within the outer vessel and is at least partially separated from the outer vessel, the inner sleeve comprises at least one aperture extending along substantially an entire length of the inner sleeve and being configured to allow fluid communication between the inner sleeve and the outer vessel such that fluid in the inner sleeve is freely flowable between the inner sleeve and the outer vessel, and the lid, when closed, prevents escape of the fluid from the extinguisher.

2. The portable extinguisher according to claim 1, wherein the outer vessel is at least partially transparent.

3. The portable extinguisher according to claim 1, further comprising a fluid level indicator.

4. The portable extinguisher according to claim 1, wherein the outer vessel includes at least one guide configured to position the inner sleeve within the outer vessel.

5. The portable extinguisher according to claim 1, wherein the inner sleeve is removable from the outer vessel by a user.

6. The portable extinguisher according to claim 1, further comprising a stopper configured to limit the extent a smoking article can extend into the extinguisher.

7. The portable extinguisher according to claim 1, further comprising a lip defining the opening, wherein the lip is curved.

8. The portable extinguisher according to claim 1, further comprising a lip defining the opening, wherein the lip is rounded.

9. The portable extinguisher according to claim 1, further comprising a lip defining the opening, wherein the lip is heat-resistant.

10. The portable extinguisher according to claim 1, further comprising a clip configured to attach the extinguisher to another object.

11. A pack of smoking articles comprising a portable extinguisher according to claim 1, wherein the extinguisher comprises a clip arranged to attach the extinguisher to the pack, and wherein the extinguisher is attached to the pack by the clip.

12. A portable extinguisher for extinguishing a single smoking article at a time, the extinguisher comprising:

an outer vessel;

an inner sleeve, the inner sleeve being disposed within the outer vessel, being at least partially separated from the outer vessel, and comprising at least one aperture extending along substantially an entire length of the inner sleeve and being configured to allow fluid communication between the inner sleeve and the outer vessel such that fluid in the inner sleeve is freely flowable between the inner sleeve and the outer vessel;

an opening sized to receive a single smoking article into the inner sleeve;

fluid being contained within the inner sleeve and outer vessel; and a lid configured to close the extinguisher, and the lid, when closed, preventing escape of the fluid from the extinguisher.

13. The portable extinguisher according to claim 12, wherein the fluid comprises water.

14. The portable extinguisher according to claim 12, wherein the fluid comprises powder.

15. A pack of smoking articles comprising a portable extinguisher according to claim 12, wherein the extinguisher comprises a clip arranged to attach the extinguisher to the pack, and wherein the extinguisher is attached to the pack by the clip.

* * * * *